US006435206B1

(12) United States Patent
Minnick

(10) Patent No.: US 6,435,206 B1
(45) Date of Patent: Aug. 20, 2002

(54) PLUMBING FIXTURE SUPPLY ASSEMBLY

(75) Inventor: Michael W. Minnick, North Ridgeville, OH (US)

(73) Assignee: Oatey Company, Cleveland, OH (US)

( * ) Notice: Subject to any disclaimer, the term of this patent is extended or adjusted under 35 U.S.C. 154(b) by 0 days.

(21) Appl. No.: 10/079,101

(22) Filed: Feb. 18, 2002

Related U.S. Application Data

(60) Provisional application No. 60/278,143, filed on Mar. 23, 2001.

(51) Int. Cl.[7] ..... F16L 5/00
(52) U.S. Cl. ..... 137/360; 312/242; 251/148
(58) Field of Search ..... 137/360; 251/148; 312/229, 242

(56) References Cited

U.S. PATENT DOCUMENTS

| | | | | | |
|---|---|---|---|---|---|
| 3,096,782 | A | * | 7/1963 | Williams | 137/360 |
| 3,148,698 | A | * | 9/1964 | Arnold | 137/360 |
| 3,834,781 | A | | 9/1974 | Logsdon | |
| 4,410,004 | A | * | 10/1983 | Kifer et al. | 137/360 |
| 3,831,624 | A | | 8/1984 | Doumany | |
| 4,564,249 | A | * | 1/1986 | Logsdon | 312/229 |
| 4,716,925 | A | | 1/1988 | Prather | |
| 5,261,444 | A | * | 11/1993 | Childers | 137/360 |
| 5,305,785 | A | * | 4/1994 | Humber | 137/360 |
| 348,506 | A | | 7/1994 | Stachowiak | |
| 5,538,033 | A | * | 7/1996 | Condon | 137/360 |
| 5,577,530 | A | * | 11/1996 | Condon | 137/360 |
| 382,941 | A | | 8/1997 | Nortier | |
| 402,353 | A | | 12/1998 | Marcichow et al. | |
| 5,983,923 | A | | 11/1999 | Hobbs et al. | |
| 428,117 | A | | 7/2000 | Minnick | |
| 6,129,109 | A | * | 10/2000 | Humber | 137/360 |

* cited by examiner

*Primary Examiner*—A. Michael Chambers
(74) *Attorney, Agent, or Firm*—Anthony G. Eggink

(57) ABSTRACT

A valve outlet assembly for mounting to a building structure and adapted to interconnect a water supply line to a plumbing fixture or an appliance. The outlet assembly has a housing enclosure, an exterior cover and alignment and mounting assemblies which cooperate with the housing structure. A valve structure is mounted in the housing to a conduit fitting which extends through a housing wall. The valve structure is constructed and arranged to receive a water line extending to the appliance. The housing enclosure has opposing alignment and mounting assemblies which provide for various securement options to position the valve outlet assembly within a building wall.

20 Claims, 3 Drawing Sheets

PLUMBING FIXTURE SUPPLY ASSEMBLY

This application claims the benefit of U.S. Provisional Application No. 60/278,143 filed on Mar. 23, 2001.

BACKGROUND OF THE INVENTION

This invention relates generally to a plumbing fixture supply assembly for installation in a wall of a building structure. Particularly, this invention relates to a plumbing fixture supply assembly for aligning and joining plumbing components to form a valve connection structure. More particularly, the invention relates to a valve outlet assembly having a curvilinear or rounded housing configuration for enclosing a valve structure and having cooperating alignment and mounting assemblies to secure the valve outlet assembly within a building structure.

Appliances and plumbing fixtures such as icemakers, sinks, toilets, dishwashers, water softeners, washing machines, faucets, water outlets, spigots and the like, require connection to one or more waterlines provided by the plumbing in the building structure. Thus, a shut-off valve for a water supply line may be provided for connection and use to the plumbing fixture or appliance.

The plumbing fixture supply assembly or valve outlet assembly of the present invention provides a housing enclosure design which may be aligned and mounted within a building wall in a variety of configurations. The fixture assembly is constructed and arranged to connect a water supply to a valve structure for connecting to a plumbing fixture or to a waterline which extends to an appliance. Importantly, the curvalinear housing enclosure has cooperating alignment and mounting assemblies which provide for the easy installation of the valve outlet assembly housing enclosure within the wall of a building.

In the prior art, appliance water connections, such as in icemaker connections, for example, waterlines extending to the refrigerator were often tapped from nearby water pipes and coiled behind the refrigerator, for example. This plumbing arrangements potentially result in damaged and leaking water lines and the inability to easily locate shutoff valves should a leaking waterline be encountered. Regarding faucet and toilet hookups, for example, shut off valves are often mounted to the outside of the finished wall. These arrangements show holes in the wall are visually unattractive and the exposed valves and line extensions are unprotected and thus, subject to damage. Although housing structures have been proposed for connecting various waterlines, i.e., for washing machines and icemakers, the prior art housing structures have typically been limited in the manner in which they are aligned and mounted within a building wall.

The valve outlet assembly of the present invention overcomes the limitations and shortcomings of the prior art connector housing structures by providing a space saving functional housing enclosure having alignment and mounting assemblies which permit the valve outlet assembly to be aligned and secured within a building wall in a variety of ways.

SUMMARY OF THE INVENTION

The valve outlet assembly of the invention provides a housing enclosure structure with a frontal opening and having at least one aperture for interconnecting a shut-off valve to a plumbing fixture or appliance. The housing enclosure has a rounded or curvilinear configuration and cooperating means to align and mount the housing enclosure assembly to a building structure, such as to a vertical stud, or the like. The housing enclosure assembly has a valve structure mounted therein and is constructed and arranged to interconnect a water supply line to the plumbing fixture or appliance.

The assembly housing is preferably a unitary molded housing enclosure containing a valve structure mounted to the bottom panel of the housing, for example. The valve structure is connected to a downwardly extending threaded conduit fixture and a water line may be connected to the valve structure outlet. The shut-off valve structure may have a compression fitting, a threaded connection or the like to easily accept a flexible water line for extension from the valve structure.

The valve outlet assembly of the invention has a curvilinear housing enclosure which incorporates alignment and mounting structures that enable the outlet assembly to be secured in a wall, i.e., attached to studs or other structural wall members. Specifically, the valve outlet assembly may have an alignment and mounting system on each side of the housing enclosure. One alignment and mounting system comprises a pair of reinforced angled tabs or alignment guides, each holding a fastener, such as a nail, screw or other fastening device for securely fastening the assembly to a building component and the other alignment and mounting system comprises a tab with apertures for securing the assembly in an alternative manner.

The housing enclosure preferably has a curved rear wall and rounded shoulders which merge into the rounded rear wall, i.e., a sectional cylindrical structure with end walls. The alignment members permit the housing enclosure to be secured to a stud, for example, as if the housing enclosure was rectangular in structure. The opposing pair of alignment members provide for the housing enclosure to be mounted in a square and flush configuration by means of either the captive fasteners on one side or by means of screw, nails or other fastening means by the tab on the other or opposite side.

The invention provides space saving, functional housing enclosure having at least one cooperating alignment and mounting assembly which permits the valve outlet assembly to be mounted in several ways within a building wall. An adjustable and removable cover structure is provided to enable the housing enclosure to be mounted in a desired manner and to have the cover structure compensate for the depth of the housing within the finished wall.

The alignment and mounting structures of the assembly provides an installer, such as a plumber, with a choice of easy installation to accommodate the building environment, i.e., whether a vertical stud, wall covering, a bracket, or the like.

These and other benefits of this invention will become apparent from the following description by reference to the drawings.

DESCRIPTION OF THE PREFERRED EMBODIMENTS

Figure 1:
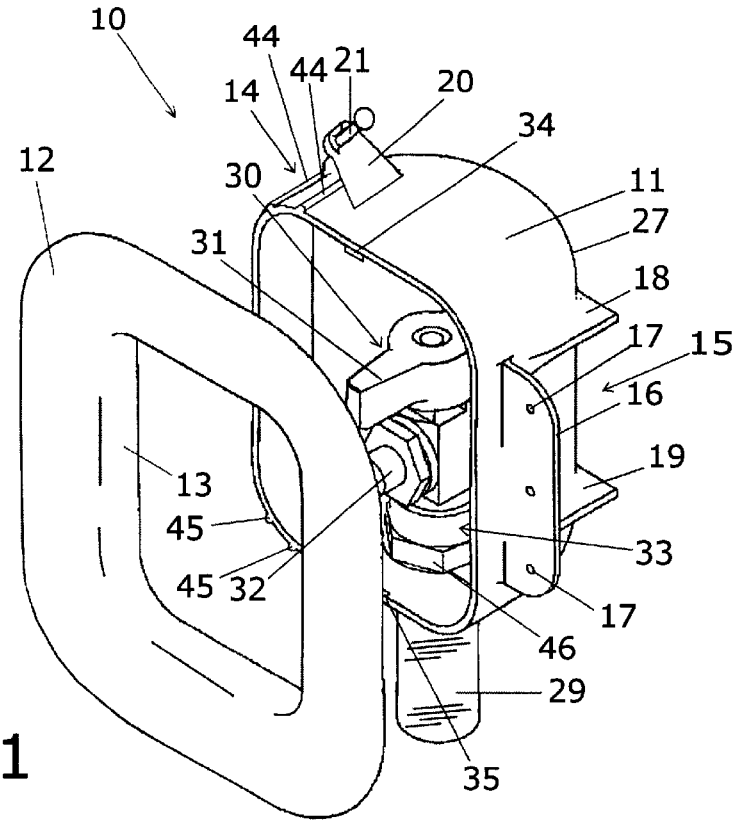
FIG. 1 is a front perspective view of the valve outlet assembly of the present invention.
Figure 2:
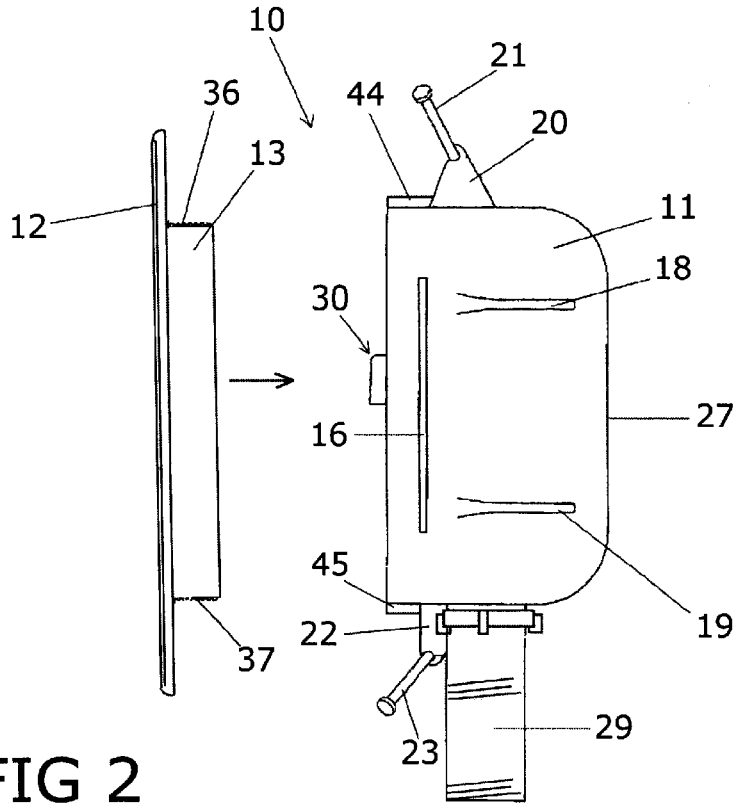
FIG. 2 is a side plan view showing the valve outlet assembly of FIG. 1.

Referring to FIGS. 1 and 2, the valve outlet assembly 10 of the present invention is shown having housing enclosure 11 with alignment and mounting means 14 and 15 on opposing sides for securing the assembly 10 to a building structure. The housing enclosure 11 is constructed and arranged to hold a conduit fitting 33 having a threaded water supply conduit 29 and which is shown extending through the bottom panel of the housing 11. A shutoff valve structure 30 is shown mounted on the fitting 33 and is positioned within the interior of the housing 11. The valve structure 30 is shown to have a water outlet line connector 32 extending from the front of valve structure 30 for connection to the water supply line that extends to the an appliance, such as an icemaker. Alternatively, the valve structure could be formed into a spigot for connection to a hose, for example. The housing enclosure 11 is shown to have an open, rounded, rectangular front and has connector members 34 and 35 at the interior top and bottom walls to receive a cover structure 12. The cover or face plate structure 12, which is of a rounded rectangular configuration, is shown removed from the housing enclosure 11.

The cover structure 12 is further shown to have an inner peripheral wall 13 which may extend into the interior of the enclosure 11. The inner peripheral wall 13 is shown to have top and bottom grooved connecting ridges 36 and 37 which cooperate with the cover connector tabs 34 and 35 of the enclosure 11 to hold the cover structure 12 in place with respect to the housing enclosure 11. The inner peripheral wall 13 of the cover structure 12 provides adjustability so that a wall covering, such as, plasterboard, or wall paneling thickness can be accommodated.

As shown further in FIGS. 1 and 2, the housing enclosure 11 is shown to have a rounded or curved body structure whereby the top, bottom and side walls of the housing terminate into and to form a rounded back wall 27. As will be further described with respect to FIGS. 7 and 8, rounded shoulders merge the walls of the housing 11 into the curved rear wall 27 of the cylindrical housing. Within the cavity or interior 28 of the housing enclosure 11 is a shutoff valve 30 having a valve lever 31. The housing enclosure 11 is configured in a manner which facilitates the placement and operation of the valve structure 30 therein. For example, a user may easily reach into the enclosure 11 and turn the lever 31 of the valve structure.

The valve structure 30 is shown mounted on a conduit fitting 33 which is comprised of a threaded water supply conduit 29 and a top portion having a wrench engaging portion 46 (i.e., hexagonal). As shown, a compression nut 38 with peripheral finger grips is utilized to secure the conduit fitting 33 to the bottom panel of the housing enclosure 11. The finger grips permit hand tightening of the nut 38. A water hammer arrester device may be incorporated with the conduit fitting 33 and valve structure 30 arrangement to absorb fluid forces when the water demand from the icemaker is abrupted.

Figure 5:
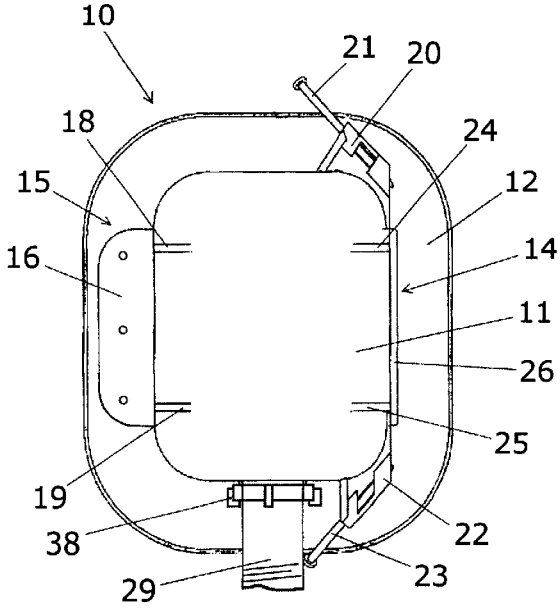
FIG. 5 is a rear plan view showing the valve outlet assembly of FIG. 1.

The unitary housing or enclosure structure 11 and the cover structure 12 are preferably constructed of a molded plastic, for example. The housing structure 11 forms an enclosure having a front opening defined by edge 48 and an aperture 41, i.e., in the bottom wall panel, to align and connect the valve structure to the water supply line. The aperture 41 may be placed in another wall area of the enclosure and the wall may have more than one aperture should additional lines be required. A compression nut 38 is shown in FIGS. 2 and 5 threaded on the threaded water supply line 29 to secure the fitting onto the bottom wall of the housing 11. The water supply fitting can be mechanically connected to the housing in a variety of ways.

Figure 4:
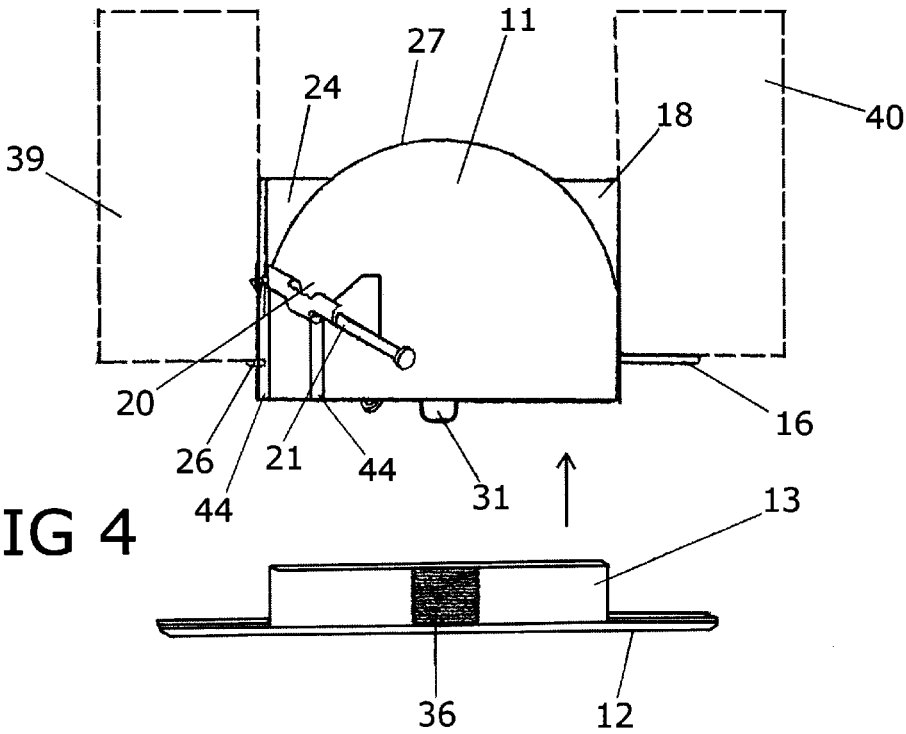
FIG. 4 is a top plan view showing the valve outlet assembly of FIG. 1.
Figure 6:
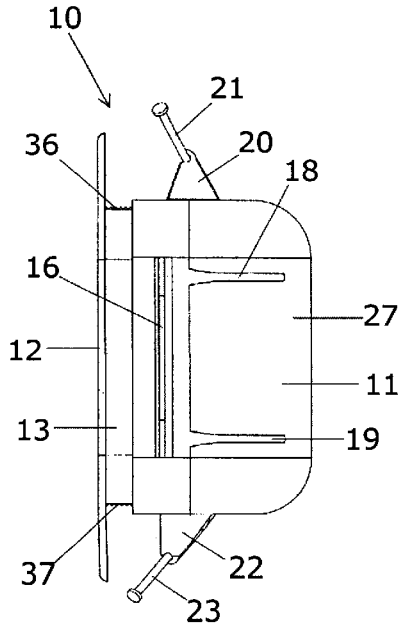
FIG. 6 is a side plan view showing the housing enclosure and cover structure of the valve outlet assembly of the invention.

Referring particularly to FIGS. 4, 5 and 6, opposing alignment members 14 and 15 are shown extending from the housing enclosure 11 and which are constructed and arranged to mount the assembly 10 in a flush arrangement to a structure, such as to studs 39 and 40. On one side of the housing enclosure 11 a pair of alignment members 18 and 19 are shown which cooperate with a mounting tab 16 having a plurality of apertures 17. On the opposite side of the housing enclosure 11 are a pair of rear alignment members 24 and 25 and a cooperating front alignment member 26. Top and bottom tabs 20, 22 and nail 21 and 23 arrangement are provided to secure the housing 11 to a building member to a structural building member, such as a wall stud or the like. The mounting tab 16 is shown to be slightly further removed than the alignment member 26 from the frontal opening of the housing enclosure 11. Because fasteners such as nails or screws may be used through apertures 17 of mounting tab 16, the heads of such fasteners are accommodated to provide for a flush housing structure with respect to a finished wall. In contrast, vertical alignment member 26, spaced approximately 0.25 inches from the frontal edge of the housing, utilizes nails 21 and 23 for fastening and need not compensate for the fastener as mounting tab 16 which is spaced approximately 0.34 inches.

Figure 3:
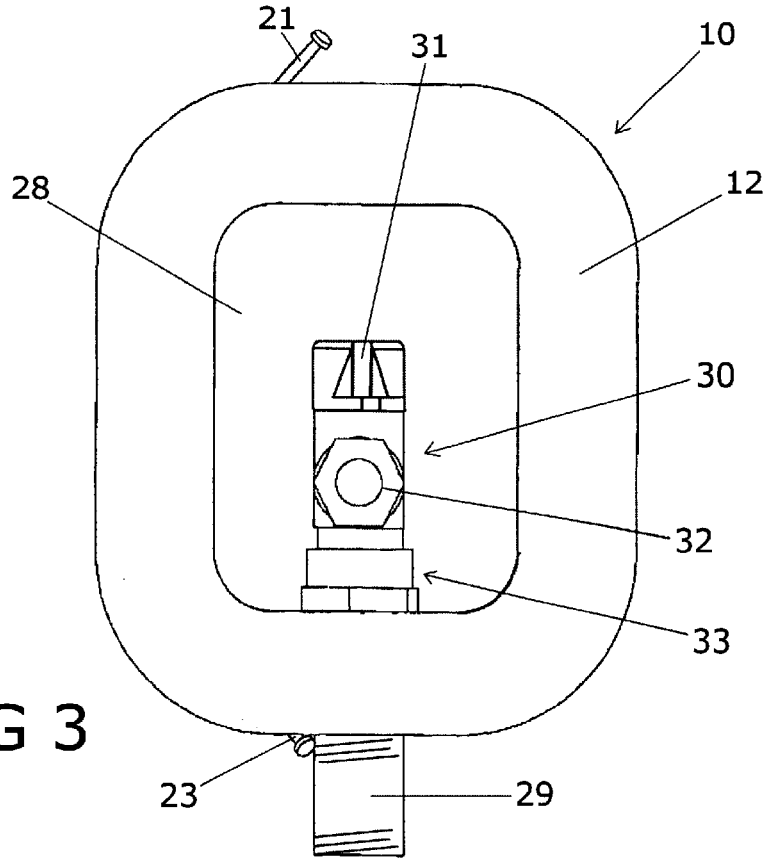
FIG. 3 is a front plan view showing the valve outlet assembly of FIG. 1.

Referring to FIG. 3, the conduit fitting 33 is shown mounted within the cavity of the housing enclosure 11. The conduit fitting 33 is shown connected to a valve structure 30, i.e., a ball valve, and a handle 31 to open and shut off the water supply. The threaded water line conduit 29 is shown extending from the conduit fitting 33 and which is adapted to be threadingly connected to a water conduit source. The connection may also be made via soldering, solvent welding or the like to a water supply pipe of the building plumbing system. The valve lever 31 controls water flow through the valve structure 30 so that water can be supplied from the conduit 29 to the water line connection extending outward from the valve structure 30. A water line, i.e., a flexible line may be connected to connection 32 and extended for connection to the plumbing fixture or appliance. For example, the water connection member 32 may be comprised of a threaded connection or a compression nut fitting, i.e., ½ inch, for connecting a ¼ inch or a ⅜ inch water supply tube which extends to the icemaker assembly, however, the connection nut may be of any desired size and adapted to receive any desired supply tube diameter.

Figure 7:
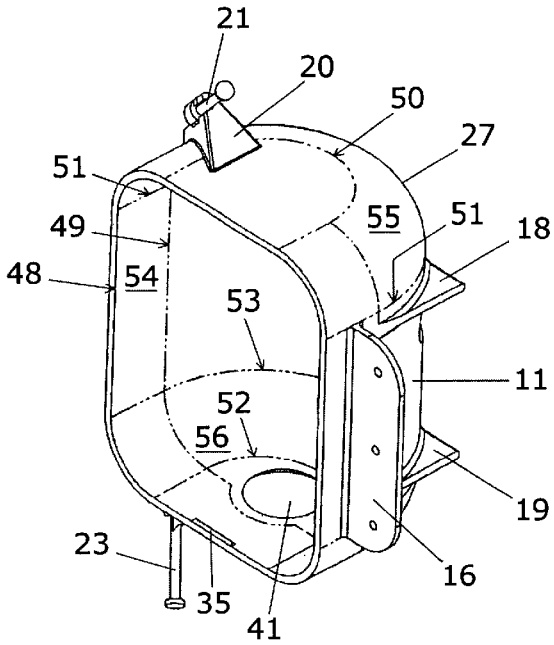
FIG. 7 is a perspective view showing the housing enclosure of the valve outlet assembly.
Figure 8:
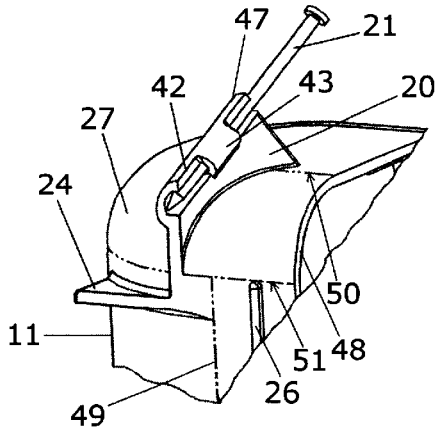
FIG. 8 is a cutaway view showing the top portion of the housing enclosure of the valve outlet assembly.

Referring to FIGS. 7 and 8, the housing enclosure 11 is shown to have a rounded or curvilinear configuration. Specifically, the housing 11 has a rounded back wall 27 which merges into and terminates at the curvilinear frontal opening edge 48. Spaced from the frontal edge 48 is demarcation line 49 which defines the plane at which the rounded back wall 27 merges into the flat sides of the enclosure 11. Further, demarcation lines 50 and 51 essentially define a top rounded shoulder which merges the rounded back wall 27 into the flat top portion of the enclosure 11. Similarly, demarcation lines 52 and 53 essentially define a bottom rounded shoulder which merges the rounded back wall 27 into the flat bottom portion of the enclosure 11. Thus, the housing enclosure 11 is a rounded or curvilinear structure having alignment and mounting systems 14 and 15 which cooperate with the economic, space saving configuration of the housing enclosure 11 so as to provide a structure which is easily mounted within a building wall.

The alignment member 26 and the mounting tab 16 are shown to extend from the housing 11 between the frontal opening edge 48 and the demarcation line 49. Further, the cooperating alignment members 18, 19 and members 24, 25 are shown to essentially begin at demarcation line 49 and to extend rearward and outward from rounded back wall 27. Also, holding tabs 20 and 22 are shown to extend generally between demarcation lines 50, 51 and 52, 53, respectively.

As further shown in FIG. 7, the bottom wall of the housing enclosure 11 is shown to have an aperture 41 and through which the threaded conduit 29 of the conduit fitting 33 extends. The housing enclosure 11 is constructed so that the arrangement of the conduit fitting 33 with the valve structure 30 mounted thereto can be placed and mounted into or removed from the enclosure 11. Further, the spaced alignment members 18 and 19 are shown extending from the rounded rear periphery of the housing enclosure 11.

The sides of the housing enclosure are therefore shown to have a planar, rounded side wall portion 54, defined by the frontal opening edge 48 and the demarcation line 54. The side wall 54 forms a curvilinear rectangle having parallel and perpendicular wall portions and rounded corner shoulders 55 and 56. The mounting tab 16 and alignment member 26 are shown to extend perpendicularly from side wall 54 and cover connectors 34 and 35 are shown to extend from the inside of the side wall 54.

The alignment members 18, 19 and 24, 25 are shown to extend rearward from and being in generally the same place from side wall 54. The rounded rear wall 27 therefore, causing the alignment members 18, 19 and 24, 25 to extend further outwardly and shown to form parallel, flat edged earlike members that are spaced from and perpendicular to mounting tab 16 and alignment member 26, respectively. The alignment members 18, 19 and 24, 25 are further shown to extend from the rounded back wall 27 parallel to and between demarcation lines 51 and 53.

The holding tabs 20 and 22 are shown generally mounted or formed on top shoulder 55 and bottom shoulder 52, respectively. It is within the purview of the invention to have the tabs 20 and 22 on one of several positions on the corner shoulders and in different orientations. For example, the housing enclosure 11 may be oriented upside down, or sideways with respect to the orientation shown in the drawing. As previously discussed, the opening or aperture 41 shown in the bottom wall in the drawing, may be positioned in any wall or portion of the housing enclosure.

Referring to FIG. 8, the holding tab 20 is shown comprised of channeled top sections 42 and 47 and a centrally disposed circular wall 43. The latter slotted top portion has a bore in which a nail 21 is held captive. The nail 21 is shown aligned and frictionally held at an angle. The bottom nail 23 is shown directed at a different angle. The nails, 21 and 23 for example, may be driven into a wooden stud to secure the housing enclosure 11. It is within the purview of the invention to utilize a screw or other fastening means in connection with the angled holder structures. As shown particularly in FIGS. 1, 2 and 4, reinforcement ridges 44 and 45 may be incorporated into the housing enclosure 11 to strengthen the respective holding tabs 20 and 22. The reinforcement ridges 44 and 45 are shown to extend from the holding tabs 20 and 22 to the frontal opening edge 48 on side wall 54.

As discussed above, the valve outlet assembly 10 is preferably molded of a unitary plastic structure as is the cover of face plate structure 12. The alignment and mounting systems shown may also be incorporated in housing enclosures used to align and connect other plumbing fixtures. An exemplary valve outlet assembly 10, used for an icemaker outlet assembly for example, may have housing enclosure 11 dimensions as follows; 4 inch height, 3 inch width, 2.25 inch depth. The cooperating face plate or cover 12 has outside dimensions of 5 inch width and 6 inch height. This housing configuration is suited to receive a conduit fixture and valve assembly having a height of approximately 4.5 inches. These dimensions are exemplary and as discussed, the plumbing fixture supply assembly of the invention may be utilized for connecting various appliances and plumbing fixtures. Thus, added apertures and lines may be required and, thus, the configuration, installation and dimensions of the assembly would vary accordingly.

Regarding the curvature of the rounded or curved elements of the housing enclosure 11, the rounded rear wall 27 for the above described valve outlet assembly 10 may have a cross-sectional radius of approximately 4 cm or 1.57 inches, for example, and the top shoulder 55 and bottom shoulder 56 may have a radius of approximately 1.65 cm or 0.65 inches, for example. For a housing enclosure constructed and arranged for multiple valve structures, i.e., washing machine outlets, the rounded rear wall 27 would be elongated, in comparison to the housing enclosure 11 shown and described herein. As a result, the elongated, curved rear wall would have rounded rear wall corner areas merged into the rounded or curved top and bottom shoulders. The rounded or curved elements for the housing enclosures of this invention provide economical, space saving housing features and further provide the installer with added wall space to align and connect pipes and to secure the assembly. The curved features may vary in shape and in radii, i.e., be elliptical or the like, and may vary in dimensions depending upon housing size and specific plumbing connection requirements.

As many changes are possible to the plumbing fixture supply assembly embodiments of this invention, utilizing the teachings thereof, the description above and the accompanying drawings should be interpreted in the illustrative and not the limited sense.

That which is claimed is:

1. An alignment and mounting system for a plumbing fixture supply assembly having a housing enclosure with opposing walls and opposing rounded shoulders merging into a rounded rear wall, said housing enclosure having a frontal opening and at least one aperture, said alignment and mounting system comprising:

a) a pair of aligned fastener holding members, one said member disposed on each said opposing rounded shoulder of said housing enclosure; and b) an elongated protrusion extending from said one enclosure wall, said elongated protrusion being parallel to and spaced a predetermined distance from said frontal opening and extending between said pair of aligned fastener holding members.

2. The alignment and mounting system of claim 1, wherein a tab member extends from a second enclosure wall and being parallel to and spaced a specified distance from said frontal opening, said tab member having at least one aperture for receiving a fastener member.

3. The alignment and mounting system of claim 2, wherein each said aligned fastener holding member further comprises an elongated cylindrical bore disposed at an angle with respect to said frontal opening and wherein each said bore is constructed and arranged to receive and hold a fastening member.

4. The alignment and mounting system of claim 1, wherein a pair of alignment tabs extend rearward from each said one enclosure wall and outward from said rounded rear wall.

5. The alignment and mounting system of claim 1, wherein said housing enclosure and said alignment and mounting system are formed of a unitary plastic composition.

6. The alignment and mounting system of claim 5, wherein said housing enclosure is constructed and arranged to receive a face cover and further wherein a face cover is provided for mounting to said housing enclosure.

7. The alignment and mounting system of claim 6, wherein said housing enclosure has interiorly disposed serrated tabs to adjustably receive said face cover.

8. The alignment and mounting system of claim 1, wherein a valve structure is mounted within said housing enclosure to form an appliance connection assembly for an icemaker, a sink connection, a toilet, a washing machine, a dishwasher, a hose spigot or a plumbing fixture requiring a shut off valve for water supply.

9. A plumbing fixture supply assembly having an alignment and mounting assembly, comprising:

a) a housing structure having a frontal opening, opposing side walls and a rounded rear wall, said housing structure having opposing rounded shoulders merging said opposing side walls with said rounded rear wall and being constructed and arranged to contain and align a valve structure therein; and b) a first alignment and mounting means positioned on one side of said housing structure and, said alignment and mounting means comprising spaced members extending from said rounded rear wall between said opposing rounded shoulders, an alignment guide member extending from said one side, said first alignment means further having means to secure said housing structure to a building structure component.

10. The alignment and mounting assembly of claim 9, wherein said housing structure has a second alignment and mounting means on said housing structure, said first and second mounting means being constructed of a unitary, molded composition.

11. The alignment and mounting assembly of claim 10, wherein an adjustable peripheral cover structure is provided for the removable securement in said frontal opening of said housing structure.

12. The alignment and mounting assembly of claim 11, wherein said plumbing fixture enclosure is constructed and arranged to provide an valve outlet assembly, wherein said housing structure has an aperture for receiving a water inlet conduit, wherein a valve assembly is mounted within said housing structure and wherein a water outlet connector is provided on said valve structure.

13. The alignment and mounting assembly of claim 9, wherein said housing structure is a molded plastic structure.

14. The alignment and mounting assembly of claim 9, wherein said alignment guide member of said first alignment and mounting means is spaced a first distance from said frontal opening on said wall and wherein said alignment guide member of said second alignment and mounting means is spaced a second distance from said frontal opening on said opposing wall whereby said first and second distance spacing provide a user with installation options in a building structure.

15. The alignment and mounting assembly of claim 12, wherein a compression fitting or a threaded connection is provided for said valve structure for providing quick connection to a flexible water line from an appliance and further wherein said valve structure is in communication with a water hammer arrester device.

16. The alignment and mounting assembly of claim 11, wherein said housing enclosure has opposing connector members on opposing inside walls of said housing enclosure and wherein said cover structure has opposing and cooperating connector members on the inside thereof to engage the connector members of said housing enclosure, said cooperating connector members being elongated members to provide adjustability of the spacing between said cover member and said frontal opening of said housing enclosure.

17. An alignment and mounting system for a plumbing fixture supply enclosure assembly comprising:

a) a housing structure constructed and arranged to form an enclosure and having an open front, a top panel, side panels and a bottom panel, one panel being constructed and arranged to receive a conduit fitting therethrough, and wherein said housing structure further has opposing connector members;

b) a cover structure with an opening having an inner peripheral wall, said inner peripheral wall having at least one grooved connecting ridge constructed and arranged to cooperate with said connector members;

c) a first mounting means contained on said housing structure constructed and arranged to mount said plumbing fixture supply enclosure assembly in a flush arrangement to a structure, said first mounting means having at least one alignment member and a mounting tab with at least one aperture therein; and d) a second mounting means contained on said housing structure constructed and arranged to mount said plumbing fixture supply enclosure assembly in a flush arrangement to a structure, said second mounting means having at least one rear alignment member, a front alignment member, a first tab and a second tab, said first and second tabs being constructed and arranged to receive a fastener member.

18. The plumbing fixture supply enclosure assembly of claim 17, wherein said housing structure and said first and second mounting means are constructed of a unitary, molded plastic composition.

19. The plumbing fixture supply enclosure assembly of claim 17, wherein said fastener member of said second mounting means is a nail or screw, and wherein said at least one aperture in said mounting tab of said first mounting means is constructed and arranged to receive a fastening member.

20. A valve outlet assembly comprising:

a) a housing enclosure within an alignment and mounting system, said housing enclosure having opposing end walls, opposing side walls, a bottom wall, a frontal opening, a rounded rear wall and opposing shoulders merging said end walls and opposing side walls into said rounded rear wall, said housing enclosure having at least one aperture;

b) a valve structure mounted within said housing enclosure, said valve structure having water inlet and water outlet means;

c) a pair of aligned fastener holding members extending angularly from said housing enclosure, one said fastener holding member extending from one said shoulder of said housing enclosure and the other said fastener holding member extending from said opposing shoulders of said housing enclosure;

d) an elongated protrusion extending from one said side wall, said elongated protrusion spaced a predetermined distance from said frontal opening and extending between said pair of aligned fastener holding members; and e) a tab member extending from a second wall and being spaced generally said predetermined distance from said frontal opening, said tab member having at least one aperture for receiving a fastener member.

* * * * *